United States Patent [19]

Yoshino et al.

[11] Patent Number: 4,467,313

[45] Date of Patent: Aug. 21, 1984

[54] AUTOMOTIVE REAR SAFETY CHECKING APPARATUS

[75] Inventors: Yasuhisa Yoshino; Masao Kodera, both of Okazaki; Hajime Ito, Aichi; Hisatoshi Ohta, Toyota, all of Japan

[73] Assignees: Nippon Soken, Inc., Nishio; Toyota Jidosha Kogyo Kabushiki Kaisha, Toyota, both of Japan

[21] Appl. No.: 320,568

[22] Filed: Nov. 12, 1981

[30] Foreign Application Priority Data

Nov. 14, 1980 [JP] Japan ..... 55-163688
Dec. 18, 1980 [JP] Japan ..... 55-182277

[51] Int. Cl.[3] ..... G08G 1/00; G08B 13/16

[52] U.S. Cl. ..... 340/904; 340/903; 340/943; 367/111; 367/909

[58] Field of Search ..... 340/32, 33, 31 R, 38 S, 340/52 H; 364/424; 367/127, 909, 111, 107, 116

[56] References Cited

U.S. PATENT DOCUMENTS 3,226,673 12/1965 Cudworth ..... 367/909
3,928,839 12/1975 Warner et al. ..... 367/111
4,015,232 3/1977 Sindle ..... 340/32
4,023,178 5/1977 Suyama ..... 340/32
4,240,152 12/1980 Duncan et al. ..... 367/909
4,260,980 4/1981 Bates ..... 340/32
4,349,823 9/1982 Tagami et al. ..... 340/33

*Primary Examiner*—Gerald L. Brigance
*Attorney, Agent, or Firm*—Cushman, Darby & Cushman

[57] ABSTRACT

An automotive rear safety checking apparatus which comprises a plurality of obstacle detectors mounted on the rear part of the automobile for radiating ultrasonic wave on the watching areas smaller in width than the width of the automobile respectively and detecting the ultrasonic wave reflected from an obstacle. The ultrasonic wave is radiated from the obstacle detectors in time division. Pulse signals in the number associated with the distance between the obstacle detector and the obstacle are generated in response to the detection of the ultrasonic wave reflected from the obstacle, so that the relative positions of the automobile and the obstacle, are indicated two-dimensionally in accordance with the pulse signal.

9 Claims, 11 Drawing Figures

AUTOMOTIVE REAR SAFETY CHECKING APPARATUS

BACKGROUND OF THE INVENTION

The present invention relates to an automotive rear safety checking apparatus for assisting the driver in confirming the safe condition rearward of the automobile.

The conventional apparatuses of this kind comprise an obstacle detector for watching the area rearward of the automobile and detecting any obstacle that my be located in the obstacle detecting area and an annunciator for informing the driver whether an obstacle is present or not.

The conventional apparatuses are such that the driver is informed only whether there is an obstacle or not in the watch area and he is totally uninformed of the relative positions of an obstacle that may be present out of his field of vision and the automobile, namely, the distance and direction etc. of the obstacle, thus making it impossible for him to check the safety rearward of the automobile sufficiently.

SUMMARY OF THE INVENTION

The present invention has been developed in order to obviate the above-mentioned disadvantage and an object thereof is to provide an automotive rear safety checking apparatus comprising a plurality of ultrasonic obstacle detectors having a watching range smaller than the width of the automobile, a control circuit for actuating the obstacle detectors sequentially by time division and processing the signals produced from the obstacle detectors, an alarm generator circuit for issuing an alarm in accordance with the relative position or distance between the automobile and the obstacle in response to the signal from the control circuit, and an indication circuit for two-dimensionally indicating the relative positions of the automobile and the obstacle in response to the signal from the control circuit, so that the driver may be properly notified of the distance between any obstacle behind the automobile and the automobile and the direction of the obstacle as viewed from the automobile in the form of aural and visual data.

DESCRIPTION OF THE PREFERRED EMBODIMENTS

Figure 1:
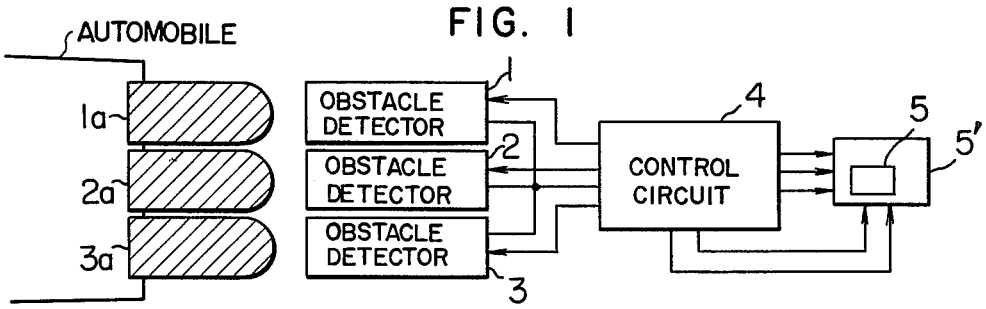
FIG. 1 is a diagram showing the construction of an embodiment of the present invention.
Figure 2:
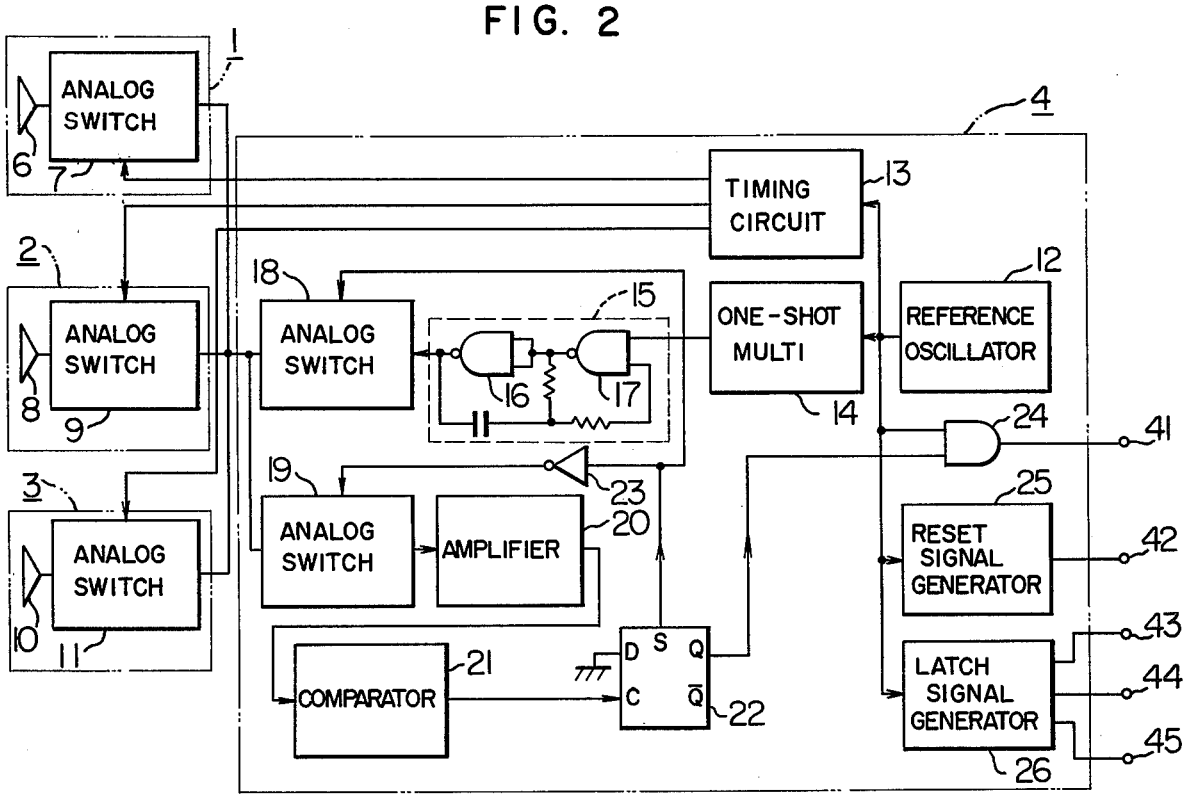
FIG. 2 is a diagram showing the detailed construction of the obstacle detector and the control circuit in FIG. 1.

The present invention will be described below with reference to the embodiments shown in the accompanying drawings. The construction of an embodiment of the present invention is shown in FIG. 1. Reference numerals 1, 2 and 3 designate first, second and third obstacle detectors respectively mounted on the automobile for detecting an obstacle, numerals 1*a*, 2*a* and 3*a* watching areas set by the obstacle detectors 1, 2 and 3 respectively, numeral 4 a control circuit for actuating the obstacle detectors 1, 2 and 3 sequentially in time division thereby to determine the presence or absence of an obstacle, numeral 5 an indication circuit for two-dimensionally indicating the presence of an obstacle, and numeral 5' an alarm sound generating circuit for issuing an alarm in accordance with the distance to the nearest obstacle. Specifically, the obstacle detector 1 includes an ultrasonic transducer 6 used for both transmission and receiving of ultrasonic wave and an analog switch 7 as shown in FIG. 2. The obstacle detectors 2 and 3, on the other hand, include ultrasonic transducers 8, 10 and analog switches 9, 11 respectively. A control circuit 4 includes a reference oscillator 12, a timing circuit 13 for controlling the operation of the analog switches 7, 9 and 11 of the obstacle detectors 1, 2 and 3 respectively in response to the output signal from the reference oscillator 12, a one-shot multivibrator circuit 14 for producing a pulse signal of a predetermined period in response to an output signal from the reference oscillator 12, two NAND gates 16 and 17, an oscillator 15 having resistors and a capacitor for interrupting the oscillation thereof in response to the output of the one-shot multivibrator circuit 14, a first analog switch 18 adapted to open only at the time of transmission of ultrasonic wave, and a second analog switch 19 adapted to open only at the time of receiving the ultrasonic wave. The control circuit 4 further includes an amplifier 20 for amplifying a received signal, a comparator 21 for comparing the output of the amplifier 20 with a setting, a flip-flop 22 with the set terminal thereof connected to the one-shot multivibrator 14, the clock terminal thereof connected to the output of the comparator 21 and the data terminal thereof connected to the earth, an inverter circuit 23 for reversing the phase of the output signal of the one-shot multivibrator circuit 14 and applying th resulting signal to the second analog switch 19, an AND gate 24 supplied with the output of the reference oscillator 12 and the output of the flip-flop 22, a reset signal generator 25 for producing a reset signal of a predetermined period, and a latch signal generator 26 for producing three latch signals of sequentially different phases.

Figure 3:
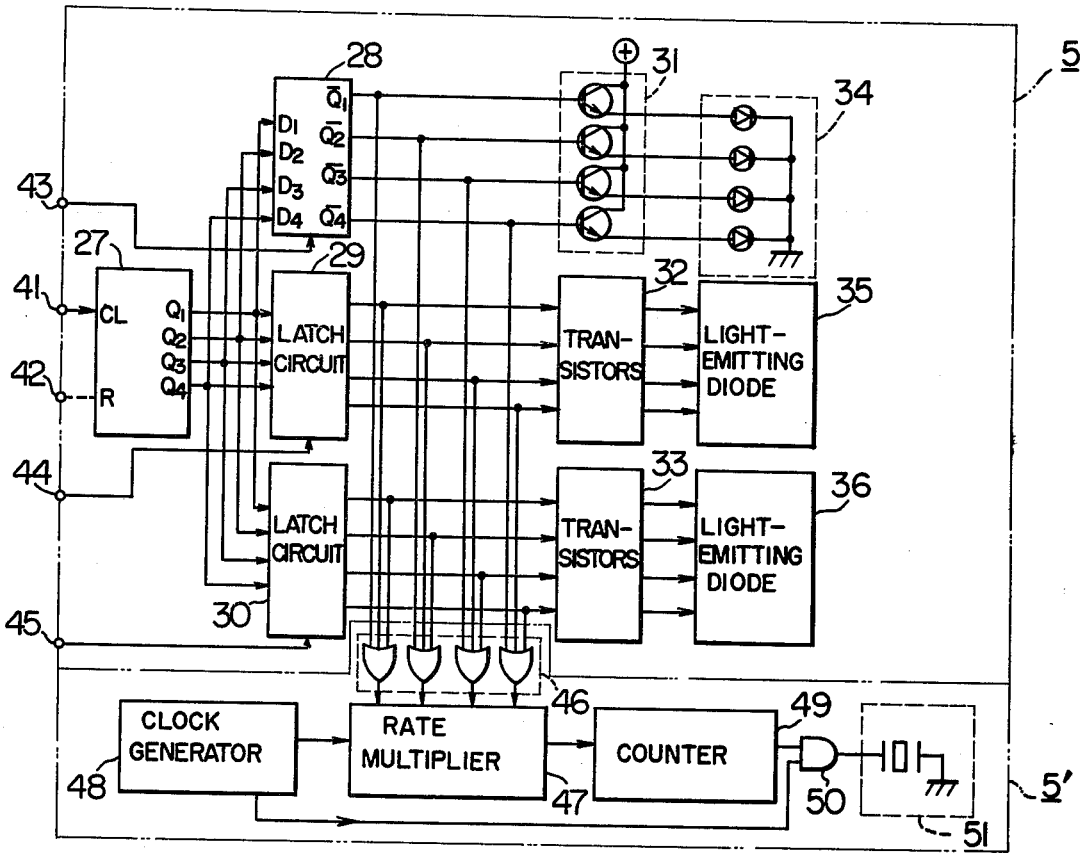
FIG. 3 shows the detailed construction of the sound alarm generator circuit and the indication circuit shown in FIG. 1.
Figure 4:
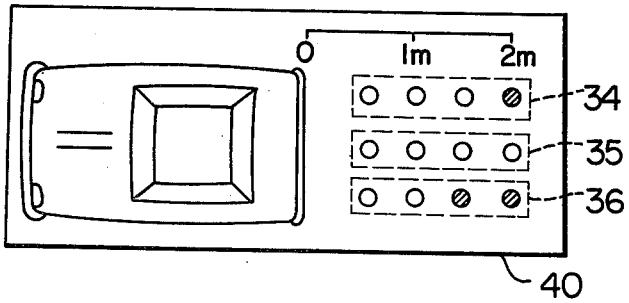
FIG. 4 is an outside view showing an example of the indication panel included in the indication circuit.

The indication circuit 5 includes, as shown in FIG. 3, a shift register 27 with the block terminal thereof connected to the output terminal 41 of the control circuit 4, the reset terminal thereof connected to the output terminal 42 of the control circuit 4 and the data terminal thereof connected to a power supply, first, second and third latch circuits 28, 29 and 30 with the data terminals thereof connected to the output of the shift register 27, and the clock terminals thereof connected to the output terminals 43, 44 and 45 respectively of the control circuit 4, first, second and third transistors 31, 32 and 33 connected to the first, second and third latch circuits 28, 29 and 30 respectively, and first, second and third light-emitting diodes 34, 35 and 36 driven by the transistors 31, 32 and 33 respectively. The light-emitting diodes 34, 35 and 36 are arranged two-dimensionally on the panel 40 illustratively representing the rear part of the automobile as shown in FIG. 4.

The alarm generator circuit 5' includes four three-input OR gates 46 connected to the first, second and third latch circuits 28, 29 and 30 respectively, a rate multiplier 47 for frequency-dividing the clock signal generated by the clock generator circuit 48 in response to the signal produced from the OR gates 46, a counter 49 for frequency-dividing the output of the rate multiplier 47 to an easily audible frequency, an AND gate 50 for interrupting the signal produced from the clock generator circuit 48 with the output signal of the counter 49 as a gate signal, and a piezoelectric buzzer 51 for converting the output of the AND gate 50 into an audible sound.

Now, the operation of the apparatus comprising the above-described components will be described with reference to the signal waveform diagram of FIG. 5.

Assume that among the watching areas 1*a*, 2*a* and 3*a* set by the obstacle detectors 1, 2 and 3, different obstacles exist in the watching areas 1*a* and 3*a*. First, the output signal 100 (FIG. 5(*a*)) of the timing circuit 13 of the control circuit 4 is applied to the analog switch 7 of the obstacle detector 1, and in similar manner, the signals 101 and 102 are applied to the analog switches 9 and 11 respectively. When the output signal 100 of the timing circuit 13 is at "1" level, the other two output signals 101 and 102 are at "0" level. Among the analog switches 7, 9 and 11, only the analog switch 7 of the obstacle detector 1 opens, while the output signal 103 (FIG. 5(*d*)) of the one-shot multivibrator circuit 14 is applied to the oscillator 15 at the same time. When this signal 103 is at "1" level, the NAND gate 17 making up the oscillator 15 functions as an inverter thereby to oscillate the oscillator 15 intermittently. This oscillation output 104 (FIG. 5(*e*)) excites the ultrasonic transducer 6 through the analog switches 18 and 7, thus radiating the ultrasonic wave to the watching area 1*a*. The ultrasonic wave pulse thus radiated is reflected on the obstacle, and part thereof is received by the ultrasonic wave transducer 6 and applied to the control circuit 4 through the analog switch 7. Under this condition, the analog switch 18 of the control circuit 4 is already closed, while the analog switch 19 is already opened, with the result that the received signal is applied through the analog switch 19 to the amplifier 20 for amplification. The output signal 105 (FIG. 5(*f*)) of the amplifier 20 is compared with the set level 105*a* at the comparator 21, the output signal 106 (FIG. 5(*g*)) of which is applied to the clock terminal of the flip-flop circuit 22. The data terminal of the flip-flop circuit 22 is grounded and the set terminal thereof is supplied with the signal 103. The output from the flip-flop circuit 22 provides a distance signal 107 having the time width t from the time of transmission of the ultrasonic wave to the time of receiving thereof representing the distance to the obstacle. The distance signal 107 is applied to one of the input terminals of the AND gate 24, and the output of the reference oscillator 12 is applied to the other input terminal thereof, with the result that a pulse train signal 108 having pulses whose number is proportional to the time width t of the distance signal 107 is produced at the output terminal of the AND gate 24 as shown in FIG. 5(*i*). This signal is applied through the terminal 41 to the clock terminal of the shift register 27 of the alarm sound generator circuit 5. On the other hand, the data terminal of the shift register 27 is connected with a power supply, and when the clock terminal thereof is supplied with a pulse signal, the outputs Q1, Q2, Q3 and Q4 of the shift register are raised to "1" level successively. When the pulse train signal 108 contains three pulses as shown in FIG. 5(*j*), the outputs Q1, Q2, Q3 and Q4 of the shift register 27 takes the values of 1, 1, 1 and 0 respectively. The outputs of the shift register are applied to the data terminals of the latch circuits 28, 29 and 30, while the latch signals 110, 111 and 112 (FIGS. 5(*k*), (*l*) and (*m*)) are applied through the terminals 43, 44 and 45 from the latch signal generator circuit 26 to the latch circuits 28, 29 and 30. Only the latch signal 110 at the terminal 43 is raised to "1" level so that the output (1, 1, 1, 0) of the shift register 27 is stored only at the latch circuit 28. The reversed output ($\overline{Q1}$, $\overline{Q2}$, $\overline{Q3}$, $\overline{Q4}$) of the latch circuit 28 takes the value of (0, 0, 0, 1), which is applied to the base of the first transistors 31, with the result that the first light-emitting diodes 34 are lit as shown in FIG. 4. The shift register 27 is reset by the reset signal 109 (FIG. 5(*j*)) produced from the reset signal generator 25, thus transferring to the state ready for the next operation. Among the outputs of the timing circuit 13, only the signal 101 is raised to "1" level, so that the obstacle detector 2 alone is actuated. In similar fashion, the other circuits are actuated, and in the absence of an obstacle in the watching area 2*a*, the second light-emitting diodes 35 are turned on as shown in FIG. 4. The operation is similar for the watching area 3*a* so that as shown in FIG. 4 the third light-emitting diodes 36 are lit with the result that the driver is able to grasp the relative positions and other data including the distance and direction of the automobile and the obstancle positioned rearward thereof.

Explanation will be made now of the alarm generator 5'. Assuming that the three outputs of the three obstacle detectors take the values (0, 0, 0, 1), (0, 0, 0, 0) and (0, 0, 1, 1) at the reversed outputs ($\overline{Q1}$, $\overline{Q2}$, $\overline{Q3}$, $\overline{Q4}$) of the latch circuits 28, 29 and 30, the outputs of the three-input OR gates 46 take the values of 0, 0, 1 and 1 from the left in FIG. 3. In other words, the data representative of the distance to the nearest obstacle is given as an output of the three-input OR gates 46. When this signal, together with a clock signal of proper frequency, is applied to the rate multiplier 47, the output of the rate multiplier 47 takes a value obtained by frequency-dividing the clock signal in accordance with the output of the three-input OR gates 46, namely, the distance to the nearest obstacle. The resulting signal, however, is not stable in period and therefore is frequency-divided appropriately at the counter 49 to sound the piezoelectric buzzer 51 through the AND gate 50. If the obstacle approaches the automobile more, the interval between sound interruptions shortens, and vice versa. When the automobile goes out of the detection area, on the other hand, the outputs of the three-input OR gates 46 are all reduced to "0" thereby to stop sounding the alarm.

The light-emitting diodes used as optical alarming elements used in the indication circuit 5 of the aforementioned embodiment may be replaced with equal effect by lamps or other fluorescent display tubes or the like. Also, instead of the piezoelectric buzzer, an ordinary buzzer or speaker may be used.

Figure 6:
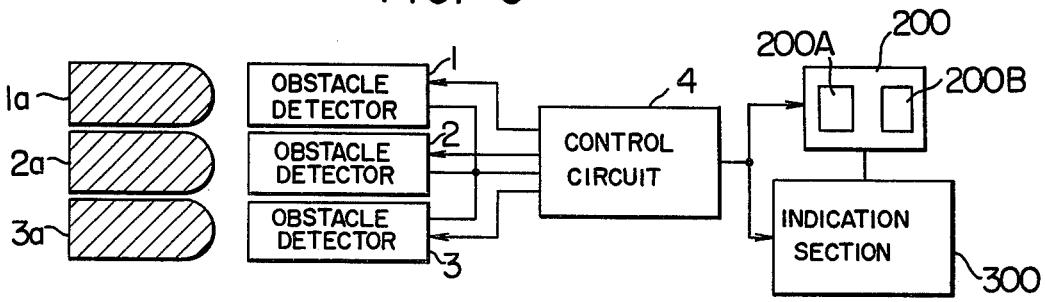
FIG. 6 is a diagram showing the construction of another embodiment of the present invention.

The construction of another embodiment of the present invention is shown in FIG. 6. The embodiment of FIG. 6 is different from the embodiment of FIG. 1 mainly in that the alarm generator circuit 200 and the indication circuit 300 are different from the alarm generator circuit 5' and the indication circuit 5 in FIG. 1 respectively. In other respects, the embodiment of FIG. 6 is almost the same as that of FIG. 1. Similar devices are denoted by similar reference numerals and will not be described again.

Figure 7:
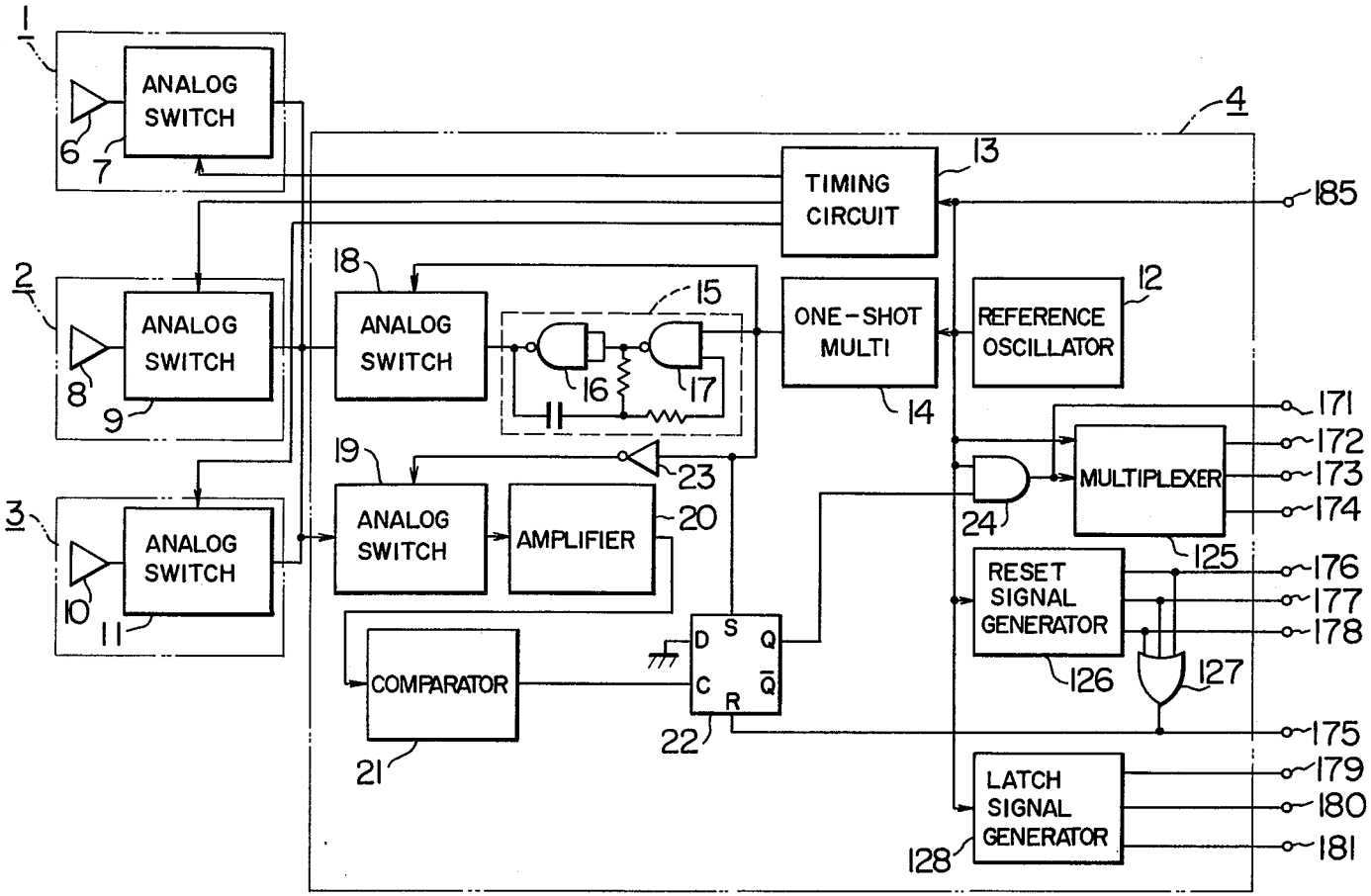
FIG. 7 is a diagram showing the detailed construction of the obstacle detector and the control circuit shown in FIG. 6.

In FIG. 7, numeral 200 designates an alarm generator section for generating an alarm in accordance with the distance to the nearest obstacle only when the automobile and the obstacle are proximate to each other. The alarm generator 200 includes a proximity decision section 200A and an alarm generator section 200B. Numeral 300 designates an indication circuit for two-dimensionally indicating the presence of the obstacle.

FIG. 7 shows the internal construction and interconnections of the obstacle detectors 1, 2, 3 and the control circuit 4. The construction of the circuit of FIG. 7 is different from that of FIG. 2 in that the part of the control circuit 4 for connection with the circuits in the later stage, that is, the indication circuit 5 and the alarm generator circuit 200 is partly different. While the other parts are almost the same. The same component elements are designated by the same reference numerals and will not be described again. The parts of the control circuit 4 for connection with the devices of later stage includes a multiplexer 125 for distributing the output signals of the AND gate 24 to the obstacle detectors, a reset signal generator 126 for producing three reset signals of sequentially different phase, a three-input OR gate 127 receiving the three reset signals and a latch signal generator 128 for producing three latch signals of different phases.

Figure 8:
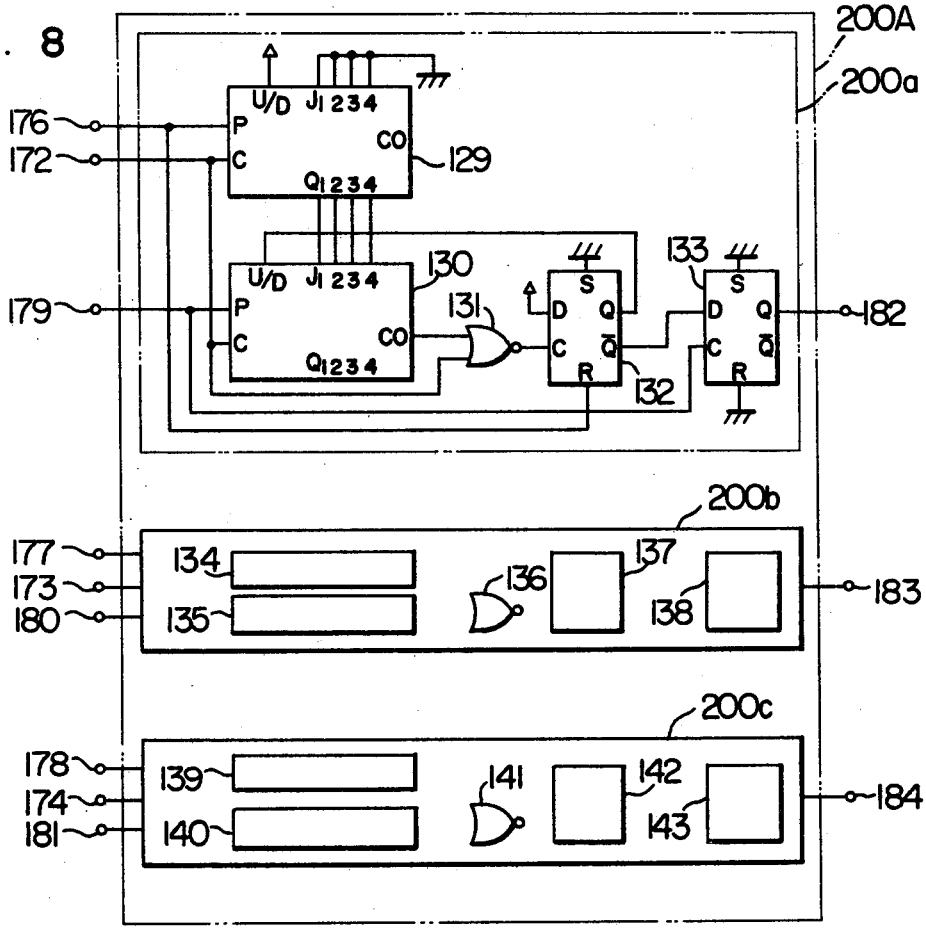
FIG. 8 is a detailed electrical circuit diagram of a proximity decision circuit shown in FIG. 6.
Figure 10:
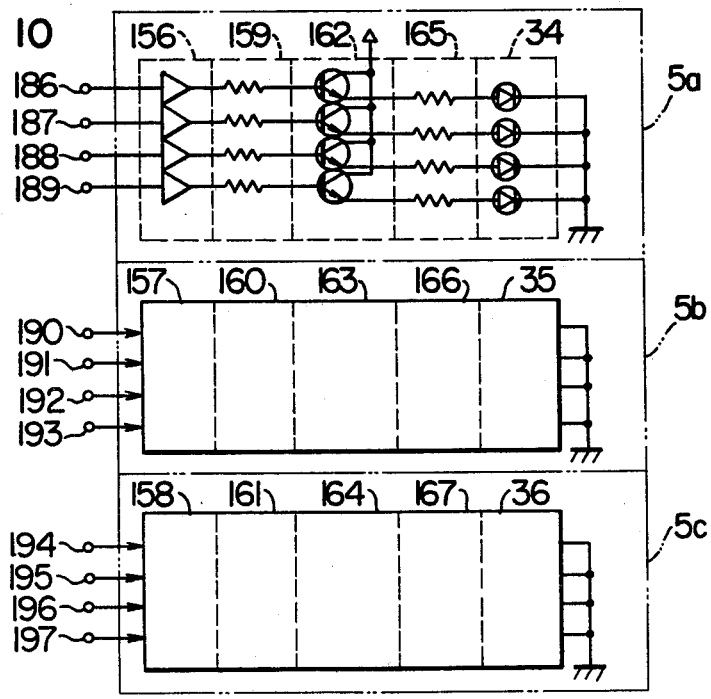
FIG. 10 is a detailed electrical circuit diagram showing an indication section shown in FIG. 6.
Figure 9:
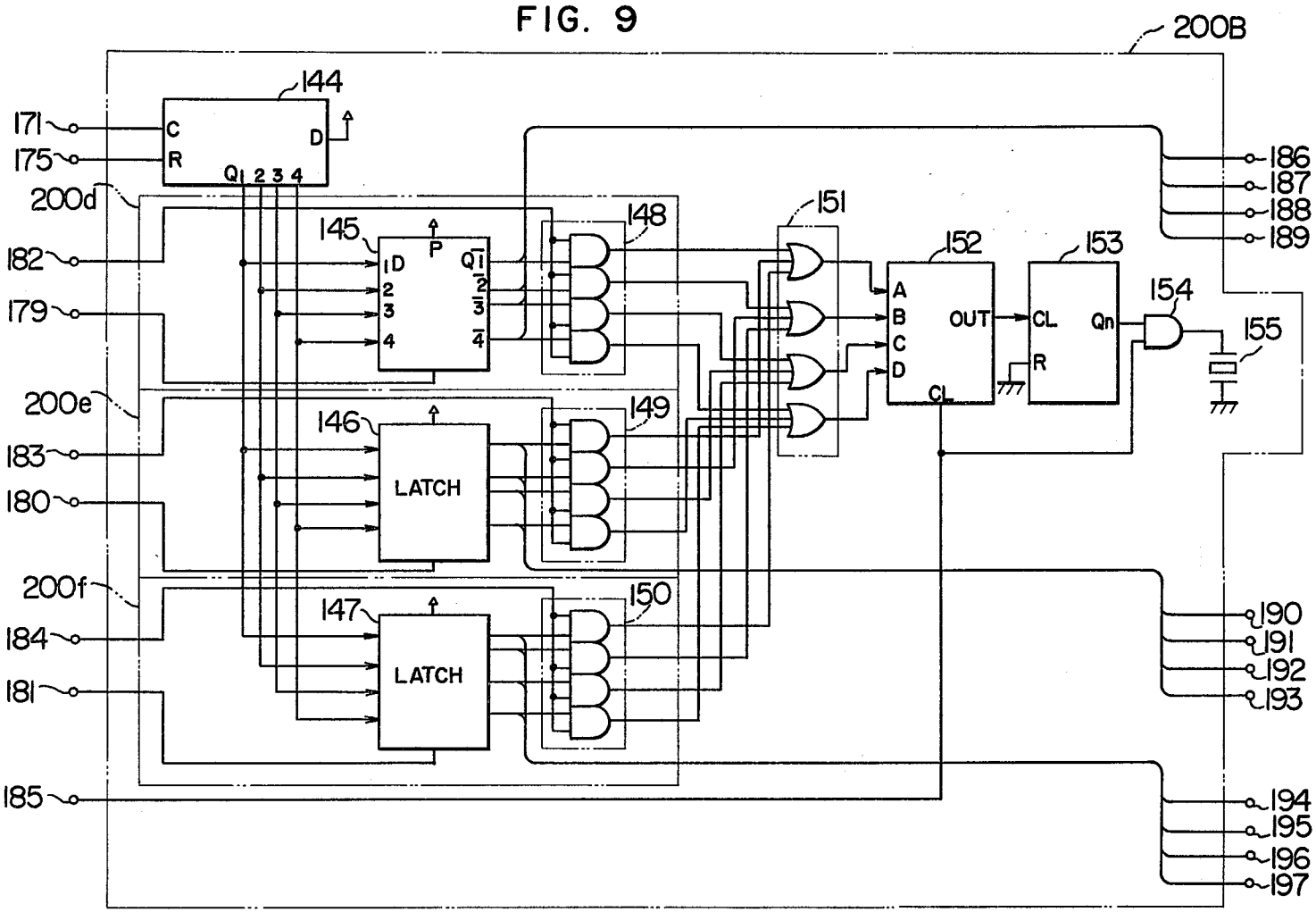
FIG. 9 is a detailed electrical circuit diagram showing the alarm generator section shown in FIG. 6.

The alarm generator section 200 includes the proximity decision section 200A and the alarm generator section 200B shown in FIGS. 8 and 9. The proximity decision section 200A, in turn, includes proximity decision circuits **200*a*, 200*b* and 200*c*. The proximity decision circuit 200*a* is connected with the output terminals 176, 172 and 179 of the control circuit 4, the proximity decision circuit 200 is connected with the output terminals 177, 173 and 180, and the proximity decision circuit 200*c* is connected with the output terminals 178, 174 and 181. The alarm generator section 200B includes a shift register 144, latch circuits 200*d*, 200*e*, 200*f*, a rate multiplier 152 and a piezoelectric buzzer 155 and is connected with the output terminals 171, 179, 180, 181, 185 of the control circuit 4 and the output terminals 182, 183, 184 of the proximity decision section 200A**.

Figure 5:
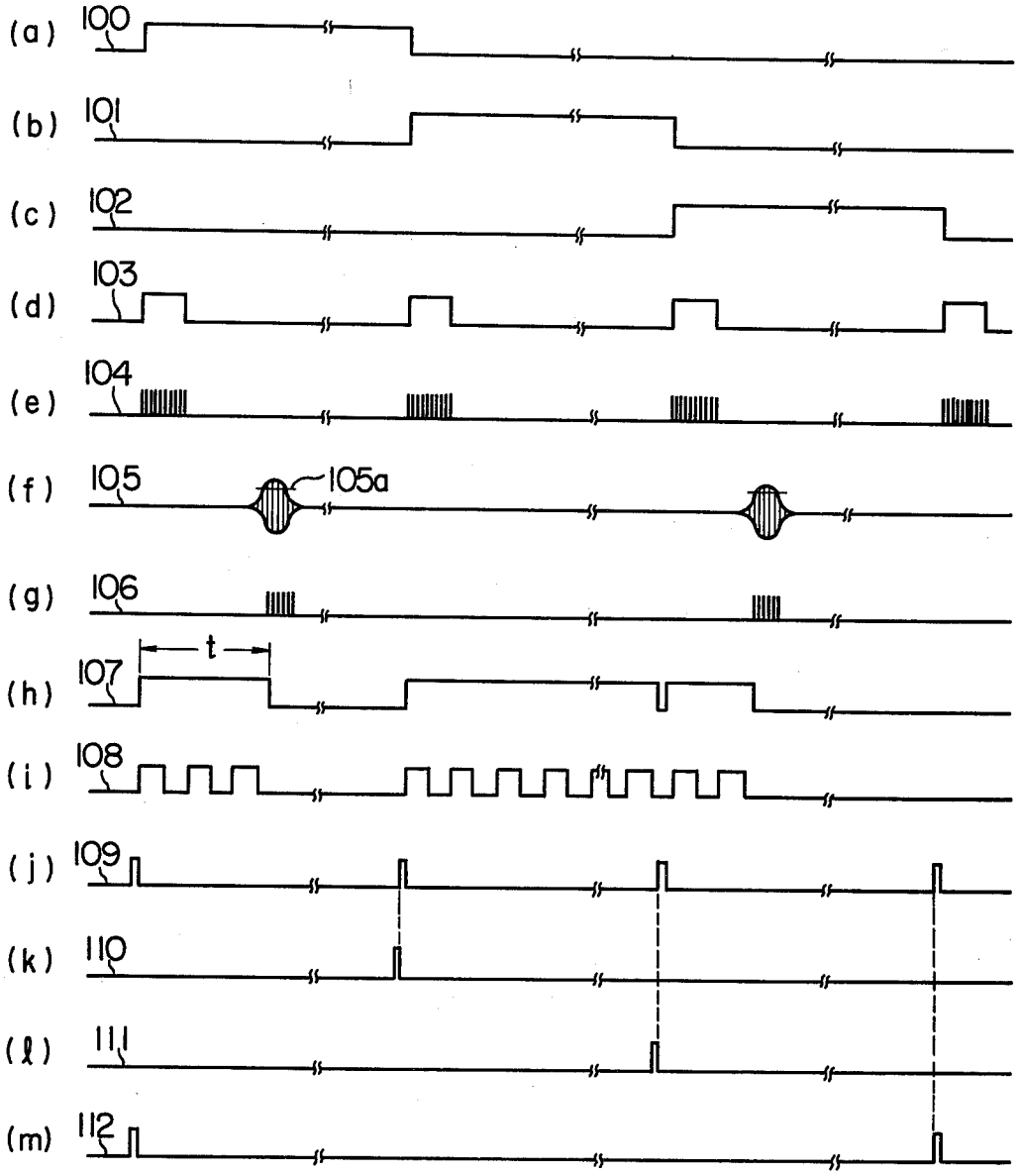
FIG. 5 shows signal waveforms for explaining the operation of the apparatus according to the present invention.

The indication section 300 includes indication circuits **300*a*, 300*b* and 300*c* as shown in FIG. 5, which in turn include buffers 156, 157, 158, transistors 162, 163, 164, and light-emitting diodes 34, 35, 36, and are connected with the output terminals 186, 187, 188, 189; 190, 191, 192, 193; and 194 195, 196, 197 of the latch circuits 200*d*, 200*e* and 200*f* respectively. The light-emitting diodes 34, 35 and 36** are arranged two-dimensionally on the panel illustratively shown in FIG. 4 as described with reference to the first embodiment.

Figure 11:
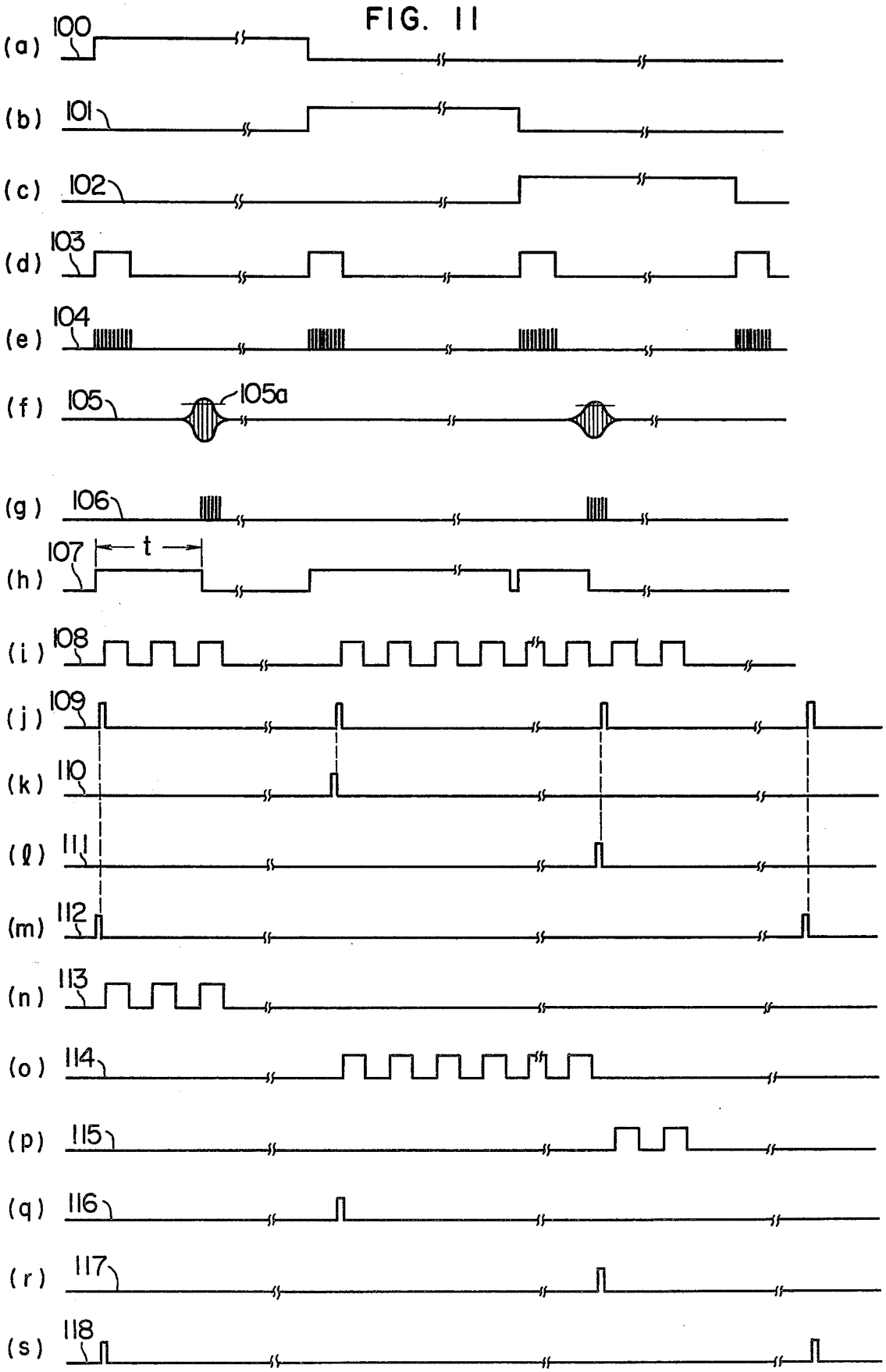
FIG. 11 shows signal waveforms for explaining the operation of the apparatus according to the present invention.

The operation of the apparatus according to the second embodiment having the aforementioned construction will be described with reference to the signal waveform diagram of FIG. 11.

As in the case of the first embodiment described with reference to FIG. 5, assume that among the watching areas **1*a*, 2*a* and 3*a* set by the obstacle detectors 1, 2 and 3 respectively, obstacles are located in the watching areas 1*a* and 3*a*. Like in the first embodiment, the output signal 100 (FIG. 11(*a*)) of the timing circuit 13 of the control circuit 4 is applied to the analog switch 7 of the obstacle detector 1. In similar fashion, the signals 101 and 102 are applied to the analog switches 9 and 11 respectively. Among the analog switches 7, 9 and 11, only the analog switch 7 of the obstacle detector 1 opens, while at the same time applying the output signal 103 (FIG. 11(*d*)) of the one-shot multivibrator circuit 14 to the oscillator 15 so that the oscillator 15 is oscillated intermittently. The oscillation output 104 (FIG. 11(*e*)) excites the ultrasonic transducer 6 through the analog switches 18 and 7 thereby to radiate the pulse ultrasonic wave on the watching area 1*a*. The pulse ultrasonic wave thus radiated is reflected on the obstacle, and part of the wave is received by the ultrasonic transducer 6, so that the received signal is applied to the control circuit 4 through the analog switch 7. The received signal is applied through the analog switch 19 to the amplifier 20 for amplification thereby. The output signal 105 (FIG. 11(*f*)) of the amplifier 20 is compared with the set level 105*a* at the comparator 21, and the output signal 106 (FIG. 11(*g*)) of the comparator 21 is applied to the clock terminal of the flip-flop circuit 22, which produces, as shown in FIG. 11(*h*), the distance signal 107 having the time width t from the transmission to the receiving of the ultrasonic wave signal associated with the distance to the obstacle. The distance signal 107 is applied to one of the input terminals of the AND gate 24, the other input terminal thereof being applied with the output of the reference oscillator 12. As a result, as shown in FIG. 11(*i*), the AND gate 24 produces a pulse train signal 108 having pulses whose number is proportional to the time width t of the distance signal 107. This signal 108 is applied through the terminal 171 to the clock terminal of the shift register 144 of the alarm generator section 200B. The data terminal of this shift register 144 is connected to a power supply, so that upon application of a pulse signal to the clock terminal, the outputs Q1, Q2, Q3 and Q4 of the shift register 144 are successively raised to "1" level. When the pulse train 108 contains three pulses as shown in FIG. 11(*i*), the outputs Q1, Q2, Q3 and Q4 of the shift register 144 take the values of 1, 1, 1 and 0 respectively. The output of the shift register 144 is applied to the data terminals of the latch circuits 200*d*, 200*e* and 200*f*, while the latch signals 110, 111 and 112 (FIGS. 11(*k*), 11(*l*) and 11(*m*) from the latch signal generator circuit 128 are applied through the terminals 179, 180 and 181 to the latch circuits 200*d*, 200*e* and 200*f*. Only the latch signal 110 at the terminal 179 is raised to "1" level, and the output (1, 1, 1, 0) of the shift register 144 is stored only in the latch circuit 200*d*. The reversed output ($\overline{Q1}$, $\overline{Q2}$, $\overline{Q3}$, $\overline{Q4}$) of the latch circuit 200*d* take the values of (0, 0, 0, 1) which are applied to the bases of the transistors 162 of the indication section 5 thereby to turn on the light-emitting diodes 34 as shown in FIG. 4. The reset signal 109 (FIG. 11(*j*)) produced from the three-input OR gate 127 which is a logic sum of the outputs of the reset signal generator 126 resets the shift register 144, thus making the apparatus ready for the next measurement. This is also the case with the watching areas 2*a* and 3*a*, in which case as in the first embodiment, the light-emitting diodes 35 are not turned on while the light-emitting diodes 36 are lit as shown in FIG. 4**.

The multiplexer 125 in FIG. 7 is for distributing the pulse train signal containing pulses in the number proportional to the time width t of the distance signal 107 to the pulse trains 113, 114 and 115 for the respective obstacle detectors. The pulse train signal 113 associated with the obstacle detector 1 is applied through the terminal 172 to the clock terminals of the presettable up-down counters 129 and 130 and the input terminal of the NOR gate 131 of the proximity decision circuit 200*a* of the proximity decision section 200 shown in FIG. 8. Assume that the data in the presettable up-down counter 130 is preset to "2" in the preceding measurement. Since the pulse train signal 113 for the present time contains three pulses as shown in FIG. 11, the data in the presettable up-down counter 130 is reduced temporarily to zero at 2–3 (i.e. when data in the counter 130 is "two" and the pulse train signal 113 contains "three" pulses), then the CO terminal thereof is reduced to "0" level, so that the D flip-flop 132 is triggered, and the outputs Q and $\overline{Q}$ change to "1" and "0" levels respectively. Thus the U/D terminal of the presettable up-down counter 130 connected to the output Q is raised to "1" level, namely, to the up count state, with the result that the data in the counter is "1". Under this condition, the data in the presettable up-down counter 129 becomes "3" since it is for up counting exclusively. Then the latch signal 110 is applied to the P terminal of the presettable up-down counter 130 and the clock terminal of the D flip-flop 133. The data "3" of the presettable up-down counter 129 is preset at the jam terminals 1–4 of the presettable up-down counter 130. The value "0" of the output $\overline{Q}$ of the D flip-flop 132 is produced at the output of the D flip-flop 133. Assume that instead of presetting the presettable up-down counter 130 to "2" on the basis of the preceding measurement, it is set to "4" which is larger than the current measurement of "2". Since the data in the presettable up-down counter 130 is not reduced to zero, the CO terminal thereof is not reduced to "0" level, so that the D flip-flop 132 is not triggered and the output of the D flip-flop 133 is "1". In the former case where the preset value of "2" is followed by the present measurement of "3", the obstacle and the automobile become relatively more distant from each other; while in the latter case where the preset value "4" is followed by the present measurement of "3", the obstacle and the automobile become relatively nearer or proximate to each other. Thus the value "1" of the D flip-flop 133 means that the present measurement is nearer than the preceding measurement, that is, the obstacle is nearer to the automobile; while the value "0" of the D flip-flop 133 indicates the present measurement is farther than the preceding measurement, that is, the obstacle is farther from the automobile. Next, the reset signal 116 (FIG. 11(*q*)) produced from the reset signal generator 126 is applied to the P terminal of the presettable up-down counter 128 and the reset terminal of the D flip-flop 132, so that the presettable up-down counter 129 is preset to "0", while the output q of the D flip-flop 132 is reset to "0", with the result that the presettable up-down counter 130 connected therewith becomes ready for down count, namely, for a pulse by the next measurement.

This is also the case with the proximity decision circuits 200*b* and 200*c*, by which the data is obtained on whether or not an obstacle in the obstacle detection areas of the three obstacle detectors 1, 2 and 3 is proximate. The outputs of the proximity decision circuits 200*a*, 200*b* and 200*c* are applied through the terminals 182, 183 and 184 to the AND gates 148, 149 and 150, one of the inputs of which is supplied with the outputs Q1, Q2, Q3 and Q4 of the four-bit latches 145, 146 and 147 of the latch circuits 200*d*, 200*e* and 200*f* of the alarm generator section 200B. When the obstacle and the automobile become relatively nearer or proximate to each other, the proximity decision circuits 200*a*, 200*b* and 200*c* produce a "1" signal and therefore the above-mentioned AND gates are opened so that the outputs are applied to the three-input OR gates 151. When the obstacle and the automobile become relatively more distant from each other, on the other hand, the proximity decision circuits 200*a*, 200*b* and 200*c* produce a "0" signal, and therefore the AND gates 151 are closed. If at least one of the three obstacle detectors 1, 2 and 3 is proximate to the obstacle, the data thereof are applied to the three-input OR gates 151 and outputted therefrom without being modified. If all the three obstacle detectors are proximate to the obstacle, on the other hand, the nearest data showing the nearest of the three is produced as an output of the three-input OR gates 151. If the three obstacle detectors 1, 2 and 3 are all far from the obstacle, the three-input OR gates 151 produce outputs of 0, 0, 0 and 0. The outputs of the three-input OR gates 151 are applied to the rate multiplier 152 so that the frequency-dividing ratio of the clock signal applied to the CL terminal is changed by the input data. The output of the rate multiplier 152, which has not a uniform period, is frequency divided by the counter 153, and in view of the substantially constant duty ratio thereof, is applied to one of the input terminals of the AND gate 154. Since the other input terminal of the AND gate 154 is supplied with the clock signal, the piezoelectric buzzer connected thereto issues an intermittent whistling sound at the period of the counter 153 at the frequency of the clock signal.

In the foregoing description, it will be seen that only when the obstacle and the automobile become relatively nearer or proximate to each other, the alarm generator section 200 acts to issue an intermittent whistling sound such that the nearer the relative distance between the obstacle and the automobile the shorter the time interval between the sounds. As a result, the driver is able to obtain aural data containing the distance data.

In the above-mentioned embodiment, as in the first embodiment, instead of the light-emitting diode, a lamp or other means including the fluorescent display tube etc. may be used as the optical alarm element of the indication circuit 300. Also, if the outputs Q1, Q2, Q3 and Q4 of the presettable up-down counters 129, 134 and 139 of the proximity decision section 200A in FIG. 3 are decoded and connected to a numeral indicator, a digital indication is possible. In similar manner, the outputs Q1, Q2, Q3 and Q4 of the presettable up-down counters 129, 134 and 139 may be subjected to A/D conversion to deflect a meter pointer.

Further, instead of changing the intervals of alarm interruptions at a predetermined frequency as in the embodiment under consideration, only the frequency may be changed without interruptions. Furthermore, in place of issuing the alarm sound through the alarm sound generator section 200B only when the obstacle and the automobile are proximate to each other as in the embodiments under consideration, the alarm may be issued also in the case where the preceding relative distance is the same as the current relative distance and in this case the alarm may be issued only when the obstacle is near the automobile.

We claim:

1. An automotive rear safety checking apparatus comprising:

a plurality of obstacle detectors provided for a corresponding plurality of watch areas made by dividing a rear area of the automobile into plural parts, each of said obstacle detectors emitting an ultrasonic wave to the corresponding watch area and receiving reflected waves from obstacles which exist in the area, control means for carrying out an obstacle detecting operation periodically and repeatedly, said obstacle detecting operation including activating said obstacle detectors successively in time division mode, causing the activated obstacle detector to emit an ultrasonic wave, determining whether said obstacle detector receives a reflected wave from an obstacle in the rear of the automobile after the emission of the reflected wave, and generating a distance signal, which corresponds to relative distance between the automobile and said obstacle, from the time between emission of the ultrasonic wave and receipt of a reflected wave from said obstacle, together with a position signal which corresponds to the activated obstacle detector, means for storing the distance signals which correspond to the position signals respectively, alarm sound generator means for generating an alarm sound which is proportionally varied in its rate of repetition to represent the distance of the shortest distance signal in the stored distance signals, and indication means including optical alarm elements arranged two-dimensionally such that said elements are arranged in one direction to represent each position of the watch area, and in another direction to represent the distance between each watch area and a detected obstacle, said optical elements being arranged in said another direction as positions extending from an end position indicating the farthest location from the automobile to another end position indicating the nearest location to the automobile, said optical elements being activated by the distance signal stored in said storing means such that the shorter the distance between the automobile and the obstacle, the more the optical elements are activated from the optical element at said end position toward the optical element at said another end position.

2. An apparatus according to claim 1, wherein each of said obstacle detectors includes an analog switch and an ultrasonic transducer; and said control means includes means for generating a timing signal, means for turning on said analog switches of said obstacle detectors successively and periodically in time division by said timing signal, means for applying an activating signal through said turned-on analog switches to said ultrasonic wave transducer of said obstacle detector supplied with said timing signal thereby to emit the ultrasonic wave on the watch area of said obstacle detector, means for receiving, through said turned-on analog switches, the electrical signal generated by said ultrasonic transducer in accordance with the ultrasonic wave reflected from the obstacle, means for generating a distance signal including a pulse signal whose number of pulses is proportional to the time between emission of the ultrasonic wave and receipt of a reflected wave from an obstacle, and means for generating a position signal which corresponds to the activated ultrasonic transducer, and said storing means includes a shaft register means for storing pulse signals in each distance signal sequentially, and a plurality of latch means corresponding to said position signals respectively, each of said latching means storing a corresponding distance signal which is output from said shaft register means.

3. An apparatus according to claim 2 wherein said alarm sound generator means includes a circuit means for receiving the inverted outputs of said latch means, in the form of a logic sum thereof and generating a distance signal representing the shortest one of the distances between the obstacle detectors and the obstacles detected thereby, and means for generating an alarm sound in accordance with the distance signal representing the shortest distance.

4. An apparatus according to claim 2, wherein said indication circuit includes a plurality of sets of light-emitting diodes arranged on a panel on which a picture display of an automobile is provided and said sets of light emitting diodes are arranged in matrix form at the rear of the pictured automobile, said respective sets of light-emitting diodes corresponding to said latch means respectively, each set of said light-emitting diodes being illuminated in accordance with the inverted output of a corresponding one of said latch means thereby to indicate the distances between the automobile and the obstacles.

5. An automobile rear safety checking apparatus comprising:

a plurality of obstacle detectors provided for a corresponding plurality of watch areas made by dividing a rear area of the automobile, each of said obstacle detectors emitting an ultrasonic wave to the corresponding watch area and receiving reflected waves from obstacles which exist in the area, a control means for carrying out obstacle detecting operation periodically and repeatedly, said obstacle detecting operation including activating said obstacle detectors successively in time division mode, causing the obstacle detector to emit an ultrasonic wave, determining whether said obstacle detector receives a reflected wave from an obstacle in the rear of the automobile after the emission of the reflected wave, and generating a distance signal, which corresponds to relative distance between the automobile and said obstacle, from the time between emission of the ultrasonic wave and receipt of reflected waves from said obstacle, together with a position signal which corresponds to the activated obstacle detector, means for storing the distance signals which correspond to the position signals respectively, an indication means including optical alarm elements arranged two-dimensionally such that said elements are arranged in one direction to represent the position of the watch area, and in another direction to represent that distance between each watch area and a detected obstacle, said optical elements being arranged in said another direction at positions extending from an end position indicating the farthest location from the automobile to another end position indicating the nearest location to the automobile, said optical elements being activated by the distance signal stored in said storing means such that the shorter the distance between the automobile and the obstacle, the more the optical elements are activated from the optical element at said end position toward the optical element at said another end position, alarm sound control means for receiving position signals and distance signals from said control means and comparing each distance signal to a distance signal generated one cycle previously, generating an alarm signal which corresponds to the distance signal, when it is determined by the comparison that the relative distance between the automobile and said object is becoming shorter, and storing the current distance signal for comparison during the next cycle, and an alarm sound generator means for generating an alarm sound which corresponds to the shortest distance signal.

6. An apparatus according to claim 5, wherein each of said obstacle detectors includes an analog switch and an ultrasonic transducer; and said control means includes means for generating a timing signal, means for turning on said analog switches of said obstacle detectors successively and periodically in time division by said timing signal, means for applying an activating signal through said turned-on analog switches to said ultrasonic wave transducer of said obstacle detector supplied with said timing signal thereby to emit the ultrasonic wave on the watch area of said obstacle detector, means for receiving, through said turned-on analog switches, the electrical signal generated by said ultrasonic transducer in accordance with the ultrasonic wave reflected from the obstacle, means for generating a distance signal including a pulse signal whose number of pulses is proportional to the time between emission of the ultrasonic wave and receipt of a reflected wave from an obstacle, and means for generating a position signal which corresponds to the activated ultrasonic transducer, and said storing means includes a shift register means for storing pulse signals in the distance signal sequentially, and a plurality of latch means corresponding to said position signals respectively, each of said latch means storing a corresponding distance signal which is output from said shift register means.

7. An apparatus according to claim 6, wherein said indication circuit includes a plurality of sets of light-emitting diodes arranged on a panel on which a picture display of an automobile is provided and said sets of light emitting diodes are arranged in matrix form at the rear of the pictured automobile, said respective sets of light-emitting diodes corresponding to said latch circuits in said store means respectively, each set of said light-emitting diodes being illuminated in accordance with the inverted output of a corresponding one of said latch circuits thereby to indicate the distances between the automobile and the obstacles.

8. An apparatus according to claim 6, wherein said alarm sound control means includes a plurality of proximity decision circuits corresponding to the position signals, each of said proximity decision circuits including a first presettable up-down counter for counting pulse signals in a corresponding distance signal from said control means, a second presettable counter to which the number of pulses in the distance signal in the preceding cycle is set, said second counter receiving pulse signals in said distance signal and down-counting, and means for generating a signal indicative that the distance between the automobile and an obstacle is becoming shorter upon detecting that the content of said second presettable down counter has become zero.

9. An apparatus according to claim 8, wherein said alarm sound generating means includes means for implementing for each said latch means a respective logical product of the inverted output of said latch means in said store means and with an output of the corresponding proximity decision circuit, means for implementing a logical sum of said logical products to generate a distance signal indicative of the shortest one of the distances between the automobile and obstacles which are coming nearer to the automobile, and means for generating an alarm sound in accordance with the distance signal.

* * * * *